United States Patent [19]

Sasaki et al.

[11] Patent Number: 4,481,509

[45] Date of Patent: Nov. 6, 1984

[54] RASTER-SCANNED DISPLAY SYSTEM FOR DIGITALLY-ENCODED GRAPHICS

[75] Inventors: Akira Sasaki, Los Angeles; William J. Davis, Thousand Oaks, both of Calif.

[73] Assignee: RCA Corporation, New York, N.Y.

[21] Appl. No.: 512,569

[22] Filed: Jul. 11, 1983

Related U.S. Application Data

[63] Continuation of Ser. No. 217,842, Dec. 18, 1980, abandoned.

[51] Int. Cl.[3] ..... G09G 1/16

[52] U.S. Cl. ..... 340/728; 340/727; 340/703; 340/799; 364/518

[58] Field of Search ..... 340/728, 727, 703, 701, 340/736, 732, 750, 798, 799, 747; 364/518, 521

[56] References Cited

U.S. PATENT DOCUMENTS

| | | | |
|---|---|---|---|
| 3,418,518 | 12/1968 | Reese, Jr. | 340/724 |
| 3,868,672 | 2/1975 | Johnson | 340/736 |
| 3,925,776 | 12/1975 | Swallow | 340/804 |
| 3,944,997 | 3/1976 | Swallow | 340/717 |
| 4,217,577 | 8/1980 | Roe et al. | 340/703 |
| 4,225,861 | 9/1980 | Langdon, Jr. et al. | 340/703 |
| 4,240,073 | 12/1980 | Seats et al. | 340/703 |

*Primary Examiner*—Marshall M. Curtis

*Attorney, Agent, or Firm*—Joseph S. Tripoli; George E. Haas; Allen LeRoy Limberg

[57] ABSTRACT

The positional resolution of a display of graphic information generated from a digital-encoded description taken from memory is improved without increasing the fine-line resolution of the display, this being done to reduce the memory required to store the digitally encoded description of the display. The departure of the pixels in the display from their normal position in a raster defined by a relatively coarse scanning line structure and limited video bandwidth is digitally encoded; and the bits of the code are stored in respective memory planes, each having an array of storage locations mapping the normal positions of pixels in the display raster.

19 Claims, 9 Drawing Figures

RASTER-SCANNED DISPLAY SYSTEM FOR DIGITALLY-ENCODED GRAPHICS

This is a continuation of application Ser. No. 217,842, filed 12/18/80 now abandoned.

The invention, in its various aspects, relates to raster-scanned display systems for displaying graphic information extracted from digitally-encoded descriptions taken from memory and, more particularly, to improvements in obtaining the positional resolution of the displays desired in such systems.

An example of such a display system is the electronic attitude-direction indicator (EADI) employed in aircraft. Raster-scanned cathode-ray-tube (CRT) display systems are to be preferred in this application over stroke-writing CRT display systems using jump scanning because of the savings in deflection power to be realized in the rather complex display. The regularity of the deflection waveforms in raster scanning permits deflection to be achieved with a relatively inexpensive electromagnetic deflection coil system, resonated so that during the alternating trace and retrace periods the same energy can be recycled in the deflection coil controlling sweep in the direction (usually horizontal) of rapid display scan. Then, only the system losses have to be supplied by the sweep circuitry driving this deflection coil. The reduction in energy loss, dissipated as heat in the sweep circuitry, makes it possible to cool the display system without need for forced-air cooling or extensive heat-sinking, making the system practical for use in small, as well as large, aircraft.

In the data processor generating the digital signal to be used for displaying graphic information by the raster scanning technique, the display is conventionally analyzed as a rectangular array of individual "picture elements" (or pixels, for short) arranged in rows and columns. These rows and columns are identified by unchanging Cartesian (i.e., x-y) co-ordinates expressed as digitally-coded binary numbers, both in the memory in which the information to write the display is stored, and in the circuitry generating the numbers for storage. In developing the digital data to describe a line vector traversing the display, at each pixel location across which the line passes, the intensity of the electron beam trace to be written in specified as being at one of a limited number of previously defined analog levels, which level is digitally encoded. Any number of levels can be encoded in a digital code of n binary digits ("bits") where n is $\log_2$ of the number of levels if it is an integral power of two. Otherwise n is the next higher number that is an integral power of two. The decision process involved in the digital encoding involves a quantizing error which becomes more serious as the number of quantizing levels is reduced. The size of the memory required for storing the information in a digitally generated display is determined by the product of the number of pixels arrayed in the display times the number n of binary digits required to encode the desired number of levels of display light intensity to be provided at each pixel location.

Where the digital code describing the display light intensity has only one bit—i.e., each electron beam writing the display is on or is off—the quantizing error is appreciable; and in a display where the number of pixels in the array is limited, slant lines—i.e., lines askew of the rows and columns of the array—are resolved with step discontinuities in them. A straight line very nearly parallel to the rows or columns of the display will be resolved as two parallel line segments with a single step-discontinuity connecting them, straight lines more askew to the major axes of the array of display pixels will exhibit staircase waveform. These step-discontinuities are annoyingly distracting to a person viewing the display, particularly if the lines in the display are rotated or translated—e.g. as the horizon vector in an EADI display is. To reduce the quantizing errors to levels where slant lines do not exhibit noticeable step discontinuities in displays of 10 cm. diagonal or so, an array of about 4,096×4,096 pixels is required, as compared to the 256×256 array of pixels required to write the display with acceptable narrow line resolution if all the lines are vertical or horizontal. To service such a 4,096×4,096 bit display, 16 megabits of refresh memory and 16 megabits of update memory are required if the display is monochromatic. These are excessive memory requirements; and, furthermore, they are coupled with the problem that the video bandwidth of the information extracted during the scanning of these memories at the rate required to avoid display flicker reaches into the tens of megahertz, making video amplifier design extremely difficult.

One approach that can be taken to reduce these refresh and update memory requirements and to avoid the excessive video bandwidths involved is to reduce the number of pixels in the array towards the array size required for adequate resolution of narrow horizontal and vertical lines and to counterfeit increased spatial resolution of the line edges with increased resolution insofar as the number of quantizing levels of electron beam intensity digitally encoded and stored in memory is concerned. These techniques result in a shading of the edges of the transitions of electron beam intensity defining a line, and the digitally generated graphics information as reconstituted for application to the CRT can thus be made to more closely resemble analog video information as generated by an iconoscope, vidicon or flying spot scanner. The savings in refresh and update memory capability come about because the information concerning electron beam intensity is stored in digital code format. So, reducing the number of pixels in the array tends toward more efficient use of memory. In the 256×256-pixel array a 16-level scale of electron beam intensity, which can be digitally coded in a 4-bit code per pixel, affords slant line resolution approaching that afforded by the 4,096×4,096 array, though with some loss of uniform intensity and width of line. The refresh and update memory requirements are each a modest 256×256×4 bits (adding up to a half megabit, rather than 16 megabits); and video bandwidth requirement is reduced to approximately that of broadcast television. The problem with this approach is that there is a tremendous increase in the complexity required in the processor and vector generator apparatus used to generate the data to be written into the update memory. However, the display memory requirements for this display system provide a standard for comparison with alternative display systems which have organization of the update and refresh memories that allow information to be read into them more efficiently, so that update of the display takes less time.

In contrast to previously known or considered arrangements, the present invention contemplates a format for display analysis in which the pixels are not considered to be fixed in their normal positions in the rows and columns of the display matrix. Instead, the pixel positions in a row or column are, in effect, adjusted by a fraction of the spacing between the normal positions of the pixel centers so that the boundaries of the pixels substantially conform to the edge of the line vector. Binary control of electron beam intensity, determining whether it is on or is off, will then resolve the line vector with adequate positional resolution even though the number of pixels in the display is relatively small—e.g., the 256×256-pixel array assumed to be the minimum for satisfactory resolution of narrowest vertical and horizontal lines to be written on the CRT display. This adjustment of pixel positions can be considered to be a minor deflection adjustment taking place at video rate and is a dynamic adjustment, changing as the positions of the line vectors in the display change. The information as to the minor deflection adjustment of the center of each pixel is digitally encoded and stored together with the information used to control the turning on and turning off of the electron beam. A four-bit code will describe 16 pixel positions intermediate between the normal ones in one of the scan directions, to provide the 256×256-pixel display positional resolution in that direction equivalent to that provided in the 4,096×4,096-pixel display. The refresh and update memories each require 256×256×5 bits; so total memory requirements are about 640 kilobits for a monochromatic display. An eight-bit code will provide the 256×256-pixel display positional resolution in both scan directions equivalent to that in the 4,096×4,096-pixel display, with 256×256×9 refresh and update memories for a total memory size of around 4½ megabits required for a monochromatic display. A five-bit code, however, suffices to provide this degree of positional resolution for a total memory size of about 750 kilobits, where only straight line vectors originating at normal pixel locations are to be provided increased positional resolution.

Figure 1:
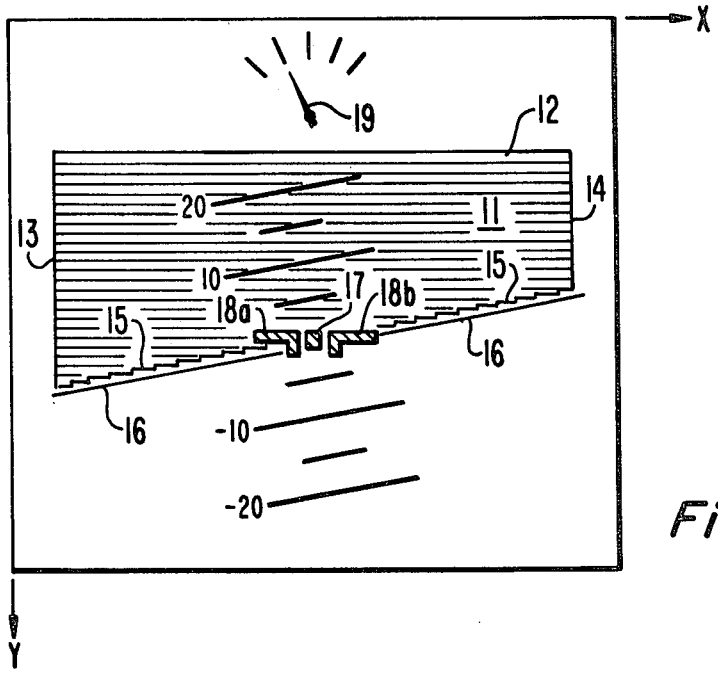
FIG. 1 is an illustration of the appearance of the CRT display that presents attitude information, with elements of that display being vectors inclined respective to horizontal trace direction.

FIG. 1 depicts a frontal view of the screen of a representative cockpit CRT display, which replaces the electromechanical ADI for providing a pilot with pitch and roll information concerning the flight of his aircraft, as that screen appears when his aircraft is in level flight, banking to the right as may occur during a turn or a slip to the right. A solid field 11 of blue color represents that portion of the pilot's view above his horizon, has a horizontal upper boundary 12, has vertical right and left boundaries 13 and 14, and has a lower boundary 15 roughly conforming to a yellow horizon-line vector 16 which rotates position according to the degree to which the aircraft banks. The relative insensitivity of the eye to blue details makes it unnecessary to correct the step discontinuities in the boundary 15, but the relative sensitivity of the eye to yellow details makes it desirable to correct the step discontinuities in horizon-line vector 16. Parallel to horizon line vector 16 are scale graduations in green, indexed 20, 10, −10 and −20 and subgraduations thereof also in green; step discontinuities in these green lines are to be corrected. The indexing numbers 20, 10, −10 and −20 are alphanumerics appearing in green on the screen. The lower left corners of their respective positions rotates together with the horizon-line vector 16 around element 17, but the alphanumerics remain upright as their positions are rotated. Element 17, green and stationary upon the CRT screen, is a stylistic representation of the fuselage of the aircraft; and elements **18*a* and 18*b*, also green and stationary upon the CRT screen, represent the left and right wings, respectively, of the aircraft. A green pointer 19 is displayed on an axis passing through element 17 and bisecting horizon-line vector 16 perpendicularly at all angles of roll, and is arched over by a fan-like array of stationary green graduations that are indices of the angle of aircraft roll or bank. Pointer 19** and these roll angle indices desirably have their inherent step discontinuities corrected for.

If the aircraft climbs, the horizon-line vector 16, the lower boundary 15 of blue field 11 parallel to 16, the graduations parallel to 16, their alphanumerics and subgraduations are all translated downward in like amounts from the positions shown in FIG. 1. Conversely, if the aircraft dives, these display elements are all translated upward in like amounts from the positions shown in FIG. 1.

The displays described may all be considered to be formed from an array of pixels at locations arranged in adjacent horizontal rows and adjacent vertical columns, which locations may be provided with Cartesian coordinate addresses, with their respective column positions expressed on integral values along an x axis and their respective row positions expressed in integral values along a y axis. Conventional raster scanning of a television display as normally viewed scans left-to-right and top-to-bottom during the painting of picture on the screen by the electron beam. So, the x and y coordinates of the pixels in the display have their origin at top left of the screen; the x axis extends positively towards the right as in conventional analytic geometry notation, but the y axis extends positively downwards contrary to conventional analytic geometry notation.

Figure 2:
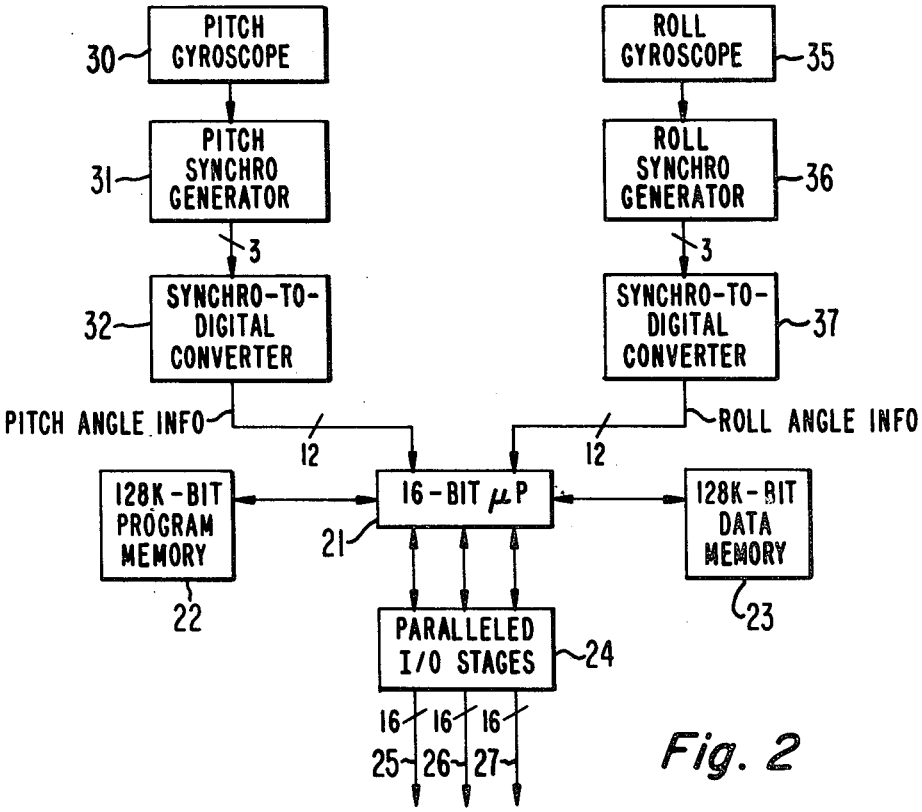
FIG. 2 is a block schematic diagram of the processor apparatus used to generate the data from which the display is generated.

In FIG. 2 a 16-bit microprocessor 21 in league with a 128-kilobit program memory 22 and a 128-kilobit data memory 23 form the heart of the computer used for specifying the coordinates of the beginning points and ending points of vectors, appearing in the display as lines or defining the boundaries of a field such as 11 of the FIG. 1 display, and for specifying the alphanumerics to be displayed together with the coordinates of their respective positions (which coordinates may, for example, be specified by the lower left corners of those alphanumerics). Data for generating the coordinates of the ends of fixed-position vectors in the display are stored in the data memory 23. Data for generating the coordinates of the ends of variable-position vectors are in part stored in data memory 23 as well, but are combined in the microprocessor 21 with further data—i.e., 12-parallel-bit words which relay pitch angle information, and twelve-parallel-bit words which relay roll angle information. The program memory 22 stores the program which directs the microprocessor 21 through the various steps required to compute the coordinates indicated at the beginning of this paragraph, which are clocked by paralleled input/output stages 24 at suitable times to 16-conductor buses 25, 26 and 27. The twelve-bit pitch angle information and roll angle information are also supplied by microprocessor 21 to the parallelled input/output stages 24 at times prescribed by program memory 22 to be clocked directly onto the buses 25, 26 and 27 at suitable times.

The pitch angle information is developed as follows. The precession of a gyroscope 30 in response to the aircraft changing its attitude respective to level flight is mechanically linked to a synchro generator 31, which generates cosine and sine components of a 400 Hz signal as an analog indication of the aircraft pitch angle. This analog indication is converted to 12-parallel-bit-word digital format by a well-known especial type of analog-to-digital converter, the synchro-to-digital converter 32. The roll angle information is developed similarly, the precession of a gyroscope 35 responsive to roll being mechanically linked to a synchro generator 36 to generate cosine and sine components of a 400 Hz signal converted to 12-parallel-bit-word digital format by a synchro-to-digital converter 37.

Figure 3:
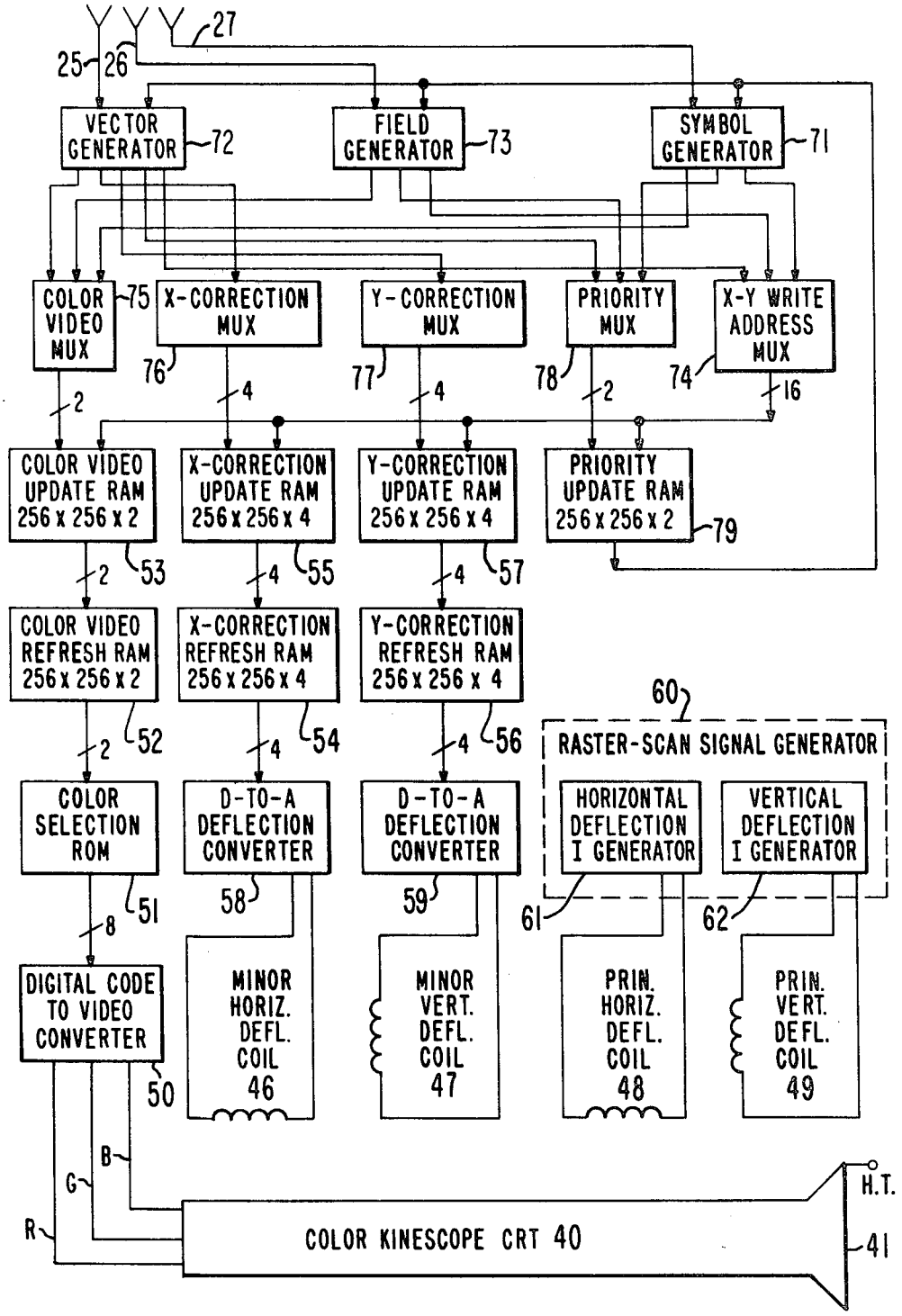
FIG. 3 is a block schematic diagram of the display generator apparatus for generating the display from that data; which apparatus in accordance with an aspect of the invention includes a memory storing fine-positioning information concerning display pixels in digital code format.

In the FIG. 3 display generating apparatus, the density of the information to be displayed on the screen 41 of the color kinescope used as the display CRT 40 is to have equal horizontal and vertical resolution as determined by a square array of pixels with 256 rows and 256 columns. This provides for 256 scan lines per frame (i.e., 256 scan lines per field for the non-interfaced display), which substantially corresponds to the 262.5 scan lines per frame of conventional broadcast television. This substantial correspondence facilitates using broadcast television receiver components in the display. The frame rate is made to be 60 per second to keep flicker acceptably low. The 256 pixels per horizontal row of display take place in about 65 microseconds so the video bandwidth requirement is of the order of 4 MHz, which is low enough so that video amplifiers (not specifically shown) similar to those in broadcast television receivers can be used in the digital-to-analog video converter 50 driving the red, green and blue electron guns of CRT 40.

The converter 50 would be simply a multiplexer for turning on one of the red, green or blue guns of CRT 40 where these primary colors were the only colors to appear in the display. But where other colors such as yellow or cyan are to be presented, converter 50 includes digital-to-analog converter circuitry to adjust the amplitudes of the drives to each of red, green and blue guns in appropriate mixture.

If the display comprising an array of pixels with 256 rows and 256 columns is a monochromatic display, the size of the random access memory (RAM) required to store the video information for refreshing this raster-scanned display would have to be 256×256-bit or 64-kilobit memory; and a RAM of similar size would be used to update this refresh memory. Each 256×256-bit array of memory cells, each cell storing a bit of information associated with a particular one of the pixels in the 256×256 pixel array on the screen 41 of the CRT 40, will be referred to in this specification as a "plane" of memory.

In a color display of green, blue, and yellow (i.e., red plus green) illumination plus lack of illumination, the four possible display conditions can be specified by two bits per pixel, which are decoded by a color selection programmable read-only memory (ROM) 51 to provide digital input to the digital-code-to-video converter 50. As each pair of locations in the respective planes of the preceding random access memory associated with a respective pixel is scanned, the 8-conductor connection of ROM 51 to converter 50 allows ROM 51 to provide converter 50 with 3 bits concerning red electron gun drive intensity, 3 bits concerning green electron gun drive intensity, and 2 bits concerning blue electron gun drive intensity. Since color selection ROM 51 requires 2 bits per pixel input information, the color video refresh RAM 52 of the FIG. 3 apparatus is a (256×256×2)-bit memory having two planes of 64-kilobit capacity and is recurrently updated from a color video update RAM 52, of similar capacity. In a system using a seven-color display (e.g., red, green, blue, magenta, cyan, yellow, and white) the capacity of the color-video update and refresh RAM's would each be increased in size to include another plane—e.g., increased to (256×256×3)-bit capacity—for a display of the same resolution.

The positional resolution in the x-direction is to be improved sixteen-fold and this requires an x-correction refresh RAM 54 with four planes of 64-kilobit capacity—i.e., a (256×256×4)-bit memory—and an x-correction update RAM 55 of similar capacity to update it. The positional resolution in the y-direction is to be improved sixteen-fold also, to which end y-correction refresh RAM 56 and y-correction update RAM 57 each of (256×256×4)-bit capacity are used. The update RAM's 53, 55 and 57 are truly random access memories and the cells in each of their planes can be addressed parallely in any desired order.

The assembly of an updated display in update memories 53, 55 and 57 is completed during each one-twentieth second update-memory-write period and is then transferred and erased. The transferrals are to the refresh memories 52, 54 and 56 with which these update memories are respectively associated, and take place during an update-memory-read period preferably lasting for the one-sixtieth second period it takes to write a raster display on the screen 41 of CRT 40. These transfers preferably take place reading the cells in the update memories in the same order as the pixels associated with them are to be displayed on the screen 41 of CRT 40. Doing this permits the CRT 40 to be operated directly from update memory while the refresh memories 52, 54 and 56 are being updated. More particularly, during this update-memory-read and refresh-memory-write period, RAM 53 directs color selection ROM 51 to supply the digital code signals to digital-code-to-video converter 50 that control the video drive it applies to the electron guns of the CRT 40. During this same period RAM 55 supplies (at video rate) minor, correctional horizontal deflection information in four-parallel-bit digital code format to a digital-to-analog power converter 58, which converts the code to a minor-horizontal-deflection current applied to the minor horizontal deflection coil 46.

And, during this same period RAM 51 supplies (at video rate) minor, correctional vertical deflection information in four-parallel-bit digital code format to a digital-to-analog power converter 59, which converts the code to a minor-vertical-deflection current applied to the minor vertical deflection coil 47.

Then, during the ensuing one-twentieth second update-memory-write period, while a new or updated display is being assembled for next cycle of operation, the display on the screen 41 of CRT 40 is recurrently redrawn three times using data from the refresh memories 52, 54 and 56. Refresh memories 52, 54 and 56 need not be true random access memories, since they are recurrently cyclically scanned, but may be other rapid-access types instead.

A raster-scan generator 60, much like that used in conventional commercial broadcast television receivers is associated with CRT 40. It comprises a horizontal-deflection-current generator 61 and a vertical-deflection-current generator 62 which generate the deflection currents applied to deflection coils 48 and 49, respectively, for conditioning these coils to develop the principal components of the electromagnetic fields that deflect any electron beam in CRT 40 in the horizontal direction and in the vertical direction, respectively. These principal deflection field components provide for the raster-scanning of the entire screen 41 of CRT 40, and they are perturbed by minor deflection field components developed by the coils 46 and 47, respectively.

These minor deflection coils 46 and 47 may, for instance, be few-turns printed-circuit coils on flexible plastic sheeting, rolled into a tube to be placed under a conventional saddle-yoke configuration of major deflection coils 48 and 49, as used in the prior-art for increasing the width of strokes by spot-wobbling. The use of minor deflection coils, separate from the principal deflection coils, permits the minor deflection coils to be operated with the wide bandwidth required for deflection at video rates (easy to do, since these coils do not have a lot of turns nor the consequently large inductance) while the major deflection coils can have the narrow bandwidth associated with their being resonated by respective capacitors (particularly important in obtaining rapid horizontal retrace without high power consumption). The filtering action of major deflection coils connected to have such narrow bandwidths would, of course, preclude the successful application of deflection information to them at video rates to perturb the deflection fields at video rates.

The same timing generator (not shown) which controls the read-out of the RAM's 52–57 (and thus the write-in of refresh RAM's 52, 54 and 56) controls the timing of the scans generated by the horizontal and vertical deflection current generators 61 and 62, so that the major and minor deflection currents are generated in proper respective timing, the timing of these control functions being derived by counting down from a master clock oscillator (not shown). As pointed out previously, update RAM's 53, 55 and 57 are ruly random access memories; and the write-in of information to them is conducted asynchronously to this master clock oscillator controlling deflection timing.

In the case of the vertical deflection system, which conventionally employs a blocking or other flywheel oscillator to control the generation of vertical scan, the natural trace period of the oscillator is made longer than desired and synchronization is achieved by injecting into the oscillator, pulses of energy with repetition rate at the desired scan rate, each of which indicates a retrace period before the end of a natural trace period can be reached. These injected pulses, obtained from the vertical sync separator in a broadcast television receiver, are in the present system supplied, one per vertical scan interval, by the timing generator referred to above. This injection-lock synchronizing system is preferable over an automatic frequency and phase control (AFPC) system for the vertical deflection current generator because it takes less time to synchronize than the AFPC system, which typically takes a few display frames to be pulled into synchronization. The horizontal deflection current generator, with its faster scan rate, may use either injection-lock or AFPC for synchronizing it to the pulses supplied to it, one per horizontal scan interval, from the timing generator.

The 16-conductor data buses 25, 26 and 27 from the FIG. 2 processor apparatus supply data to a symbol generator 71, a vector generator 72 and a field generator 73, respectively, in the FIG. 3 display generator apparatus. The timing of the transfer of this data is, for example, done by the technique known as "handshaking" where a "ready" pulse is sent out (by connections omitted from the block schematics) from the FIG. 2 processor to the one of generators 71, 72 and 73 to which data is to be supplied. The selected generator then returns a "acknowledge" pulse confirmatory of its connection to the FIG. 2 processor. The processor then supplies the data word by word to the selected one of the generators 71, 72 and 73. The selected generator sends another acknowledge pulse to the FIG. 2 processor as each data word is ingested, and has an internal counter that keeps track of how many acknowledge pulses have been transferred to the processor, which count is used inside the generator to identify the nature of the 12-bit data word being received and to direct it to a selected register for storage.

In an embodiment of the system constructed by the inventors and their colleagues, twelve-bit data words are used. The symbol generator 71 receives three twelve-bit words per character. The first of these words includes the x address of a point in the character or symbol to be presented; and the second of these words, the y address. The third word includes two bits which are color code information for specifying the color of the character, two bits which are priority code information for determining whether or not the symbol will be written in place of field or line vector information, and five bits which specify the character to ge generated. The other three bit positions in the third word are left unused.

The vector generator 72 receives a six-word message from the FIG. 2 processor. The first and second words are the x and y locations of the starting point of the vector generation process. The third and fourth words are the x and y locations of the ending point of the vector generation process. The fifth word in the angle the vector makes with a vector extending horizontally to the right, the 360° of arc being subdivided into 4,096 segments of arc by the 12-bit resolution. The sixth word is a control word with two bits of color code information specifying the color of the line to be written on the screen face, two bits of priority code information specifying whether or not the line vector will be written in place of field information (as it invariably is in the ADI display) or of characters generated by the symbol generator 71, and four bits of information specifying line vector width. The vector generator 72 outlines each of the color line vectors it generates with a black border one pixel wide, in effect drawing three parallel vectors seriatim, the first black, the second in the desired color, and the third also in black. The normally narrowest line vector width is two pixels. The field generator 73 receives a message with at least three groups of six-word messages, each defining one of the straight-line boundaries of the field in a format similar to that used to define the line vectors. The field is, however, not bordered in black.

Each of the generators 71, 72 and 73 supplies, as its output signal, a sequence of 16-bit x-y locations indicating the pixels in its portion of the display. Each of these 16-bit x-y locations is supplied together with two bits of priority code information and two-bits of color code information, carried forward in the generator from similar information supplied to it from the FIG. 2 processor together with the information used to enable the generator to carry forward its generation of display data. The color information, of course, indicates the color in which the display generated by that generator is to be written at the specified pixel locations, if the priority code information establishes that information to be more important than the information any other of the generators generates for those pixel locations.

Multiplexers 74–78 each sequentially poll for 800 nanosecond intervals the output signals from each of the generators 71, 72 and 73, as long as the data they can supply for writing a particular x-y location is of higher priority in assembling the new display than data already stored in the update RAM's 53, 55 and 57 with reference to that x-y location. In this polling process, the x-y address multiplexer 74 applies the 16-bit x-y location in the output signal of the selected one of generators 71, 72 and 73 to the addressing circuitry of each of the memory planes in the update RAM's 53, 55, and 57 and in the priority RAM 79. The color video multiplexer 75 applies the two bits of color code information supplied by the selected one of generators 71, 72 and 73 to the data inputs of respective planes of the color video update RAM 53. The x-correction multiplexer 76 and y-correction multiplexer 77 apply their respective four bits of deflection correction information from vector generator 72 to the data inputs of respective planes of the x-correction RAM 55 and y-correction RAM 57 if vector generator 72 is the selected generator. Multiplexers 76 and 77 otherwise apply (by connections not shown in FIG. 3) the signal indicating zero deflection correction to these data inputs, supposing a simple system wherein positional resolution improvement is afforded line vectors only. (Of course, the teaching of the present invention can be extended to more sophisticated systems where positional resolution of alphanumeric strokes and of field boundaries is improved.) The priority multiplexer 78 applies each of the two bits of priority code in the output signal of the selected generator to the priority RAM 79 for writing into a respective one of its memory planes.

Priority update RAM 79, however, includes circuitry for comparing the priority code, supplied to it for writing into any x-y location in its two planes, with the priority code already stored at that x-y location in its two planes. If and only if the priority code of the incoming data is superior to the code stored in the priority update RAM 79 for that x-y location, the priority RAM 79 will send signal from its output to the generators 71, 72 and 73 enabling them to generate write-enable signals. These write-enable signals are applied (by connections not shown in FIG. 3) to the RAM's 53, 55, 57 and 79 for enabling their being written by the data supplied to their respective data inputs by multiplexers 76, 77, 78 and 75, respectively, from the selected one of the generators 71, 72 and 73. This writing time is about 150 nanoseconds. If the priority code of the incoming data fails to exceed that of the data stored in the priority update RAM 79 for the specified x-y location, RAM 79 fails to send signal from its output to enable the ganerators 71, 72 and 73 to supply write-enable signals to the RAM's 53, 55, 57 and 79; and these memories are not updated.

The symbol generator 71 receives from the FIG. 2 processor the 16-bit address code for one of the points in the symbol (e.g., its lower left-hand corner), a five-bit identity code indicating what symbol is to be extracted from read-only memory (ROM) in the generator 71, the two-bit color identification code indicating the color in which the symbol is to be written, and the two-bit priority code for that symbol. From this information and by referring to ROM the symbol generator 72 is able to supply the information for locating an alphanumeric anywhere on the screen 41 of the CRT 40.

Figure 4:
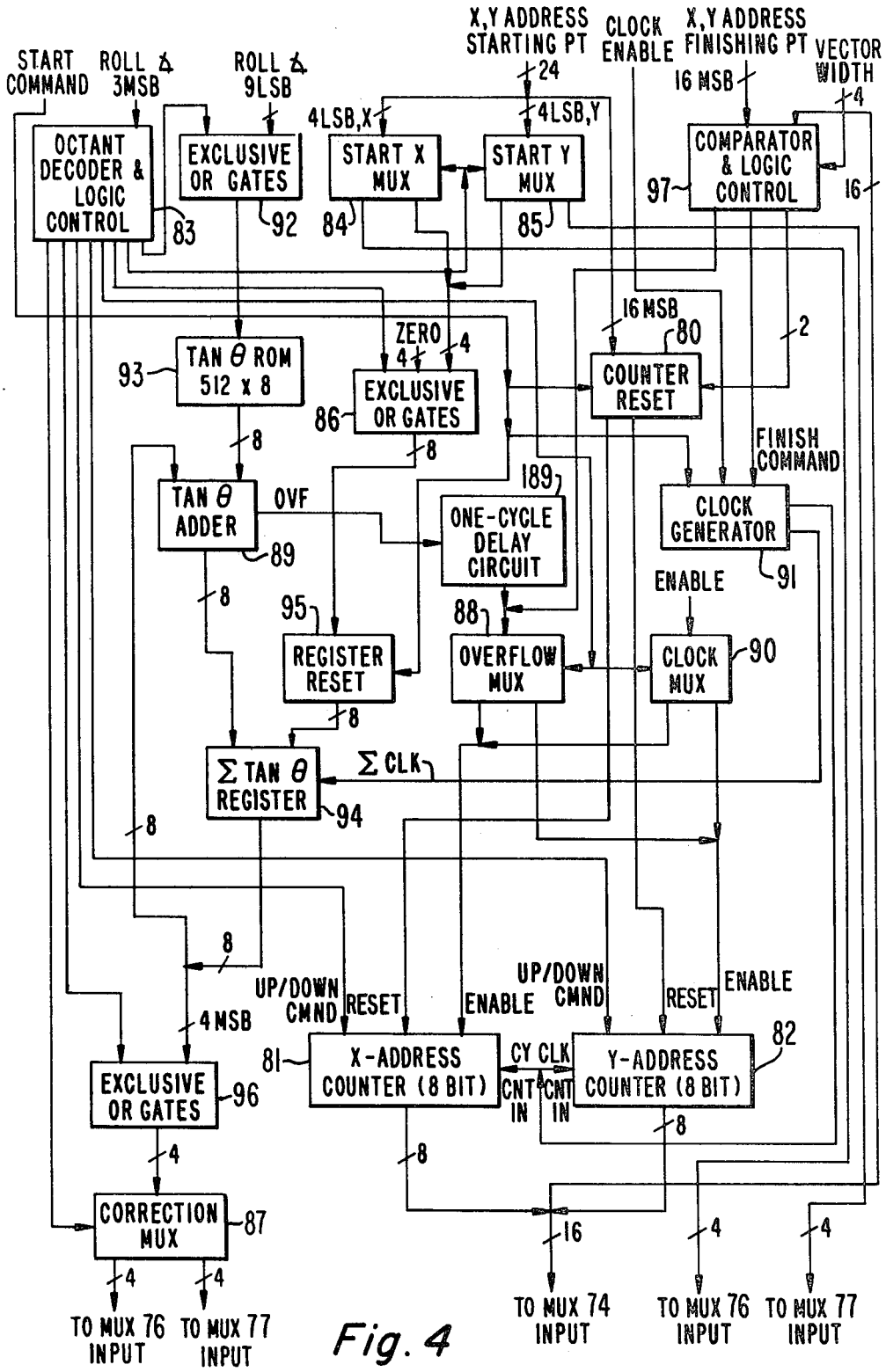
FIG. 4 is a detailed block schematic diagram of the portion of the FIG. 3 display generator apparatus used to generate line vectors for implementing apparatus in accordance with a further aspect of the invention.

The operation of the vector generator 72 will be explained with reference to the FIG. 4 block schematic and FIG. 5 timing diagram. A "start" command is generated within the vector generator 72 (by circuitry not shown in FIG. 4) a short time after vector generator 72 sends its sixth "acknowledge" pulse to the FIG. 2 processor, allowing sufficient time for the processor information to be loaded into input buffer registers of vector generator 72 (which are not shown in FIG. 4). Responsive to this "start" command counter reset circuitry 80 resets an x-address counter 81 and a y-address counter 82 to store the x and y coordinates, $X_0$ and $Y_0$, respectively, of the address of the line vector starting point. The x, y addressing of the RAM's 52–57 is controlled from x-address counter 81 and y-address counter 82. Each of these counters 81, 82 is an up/down counter, enabled by its "enable" input being supplied a "one" to be responsive to a cycle clock (CY CLK) pulse being applied to its "count" input, for incrementing its count output if an "up" command (e.g., a "one") is applied to its "up/down command" input, and for decrementing its count if a "down" command (e.g., a "zero") is applied to its "up/down command" input.

Octant decoder and logic control circuitry 83, used to control the logic of the vector generator 72 and hereinafter called simply "decoder", analyzes the three most significant bits of the roll angle information to determine which of the eight octants in 360° the vector angle falls in. The three bits of information respectively determine whether the vector is to be written left-to-right or right-to-left, whether the vector is to be written top-to-bottom or bottom-to-top, and whether the vector is closer to the vertical (in which case x-correction is to be used) or closer to the horizontal (in which case y-correction is to be used). It is convenient to generate the 45° and 215° vectors using x-correction and the 135° and 315° vectors using y-correction.

The x-address counter 81 is instructed to count up for vectors lying in any of the first, second, seventh, and eighth octants (0°–45°, 45°–90°, 270°–315° and 315°–360°, respectively) as well as for the 0°, 45° and 315° vectors; and counter 81 is instructed to count down for vectors lying in any of the third, fourth, fifth and sixth octants (90°–135°, 135°–180°, 180°–225° and 225°–270°, respectively) as well as for the 135°, 180° and 225° vectors. This instruction can be determined by one of the two most significant bits in the binary number conveying roll angle information, with the other being used for instructing the direction of count by y-address counter 82. The y-address counter 82 is instructed to count up for vectors lying in any of the first through fourth octants as well as for the 45°, 90° and 135° vectors, and counter 82 is instructed to count down for vectors lying in any of the fifth through eighth octants as well as for the 215°, 270° and 315° vectors.

X-correction is not afforded on a scanning bit-by-bit basis for line vectors closer to the horizontal than to the vertical—i.e., for line vectors falling in the first octant including 0°, the fourth octant including 135°, the fifth octant including 180° and the eighth octant including 315°. Decoder 83 responds to these conditions to cause a start-x multiplexer 84 to apply its output (the four least significant bits of the x coordinate of the x, y address of the line vector starting point) to the data input of the x-correction multiplexer 76, rather than to respective first inputs of four of a battery 86 of eight exclusive-OR gates. This transports the extra resolution bits in the x coordinate directly to the input of the x-correction multiplexer 76, inasmuch as further x-correction is not afforded. To provide for y-correction, decoder 83 directs start-y multiplexer 85 to apply the four least significant bits of the y coordinate of the x, y address of the line vector starting point to four of the first inputs of the battery 86 of eight exclusive-OR gates, rather than directly to the data input of the y-correction multiplexer 77. Data for determining y-corrections received at the input of a correction multiplexer 87 are directed to the input of y-correction multiplexer 77, rather than to the input of x-correction multiplexer 76, per instruction of decoder 83, when y-correction is to be used rather than x-correction. Decoder 83 also directs an overflow multiplexer 88 to apply overflow bits taken from an adder 89 (and delayed by one count cycle in delay circuit 189) to the enable input of y-address counter 82, and directs a clock multiplexer 90 to apply a "one" continuously to the "enable" input of x-address counter 81 so that its count is advanced each cycle of operation by the CY CLK pulses applied to its "count" input. Y-correction is accomplished using the tangent (tan) of the roll angle information, so decoder 83 directs a battery 92 of nine exclusive-OR gates to pass directly, without complementing, the nine least significant bits of the roll angle information to a read-only memory (ROM) 93 as angle $\theta$ to generate tan $\theta$ for application to the adder 89 used to add tan $\theta$ to the output of a $\Sigma$ TAN $\theta$ register 94.

Conversely, y-correction is not afforded on a scanning bit-by-bit basis for line vectors closer to the vertical than horizontal—i.e., for line vectors falling in the second octant including 45°, the third octant including 90°, the sixth octant including 225°, and the seventh octant including 270°. For these line vectors, the decoder 83 directs the following conditions. The start-x multiplexer 84 is directed to apply its output to inputs of the battery 86 of exclusive-OR gates to implement further x-correction; and the start-y multiplexer 85 is directed to apply its output to the data input of y-correction multiplexer 77 inasmuch as no further y-correction will be afforded to the line vector. Correction multiplexer 87 is directed to apply output signal corresponding to its input signal to the data input of x-correction multiplexer 76, rather than to the data input of y-correction multiplexer 77. The overflow multiplexer 88 is directed to apply overflow bits taken from adder 89 (and delayed one count cycle in delay circuit 189) to the "enable" input of x-address counter 81, rather than to the "enable" input of y-address counter 82. The clock multiplexer 90 is directed to apply a "one" continuously to the "enable" input of y-address counter 82, rather than to the "enable" input of x-address counter 81. The battery 92 of exclusive-OR gates are directed to complement the nine least significant bits of the roll angle information for application to TAN $\theta$ ROM 93, so tan $\theta$ corresponds to the cotangent rather than the tangent of the roll angle. This permits one ROM to supply both tangent and cotangent of roll angle information and halves the amount of ROM required for x- and y-correction.

The generation of summed tangent or cotangent roll angle information for correcting y or x position and shifting the y or x address counter is done on the basis of absolute (i.e., unsigned) angular deviation from horizontal or vertical axis. To pulse the count input of the y or x address counter appropriately, the decoder 83, responsive to roll angle being the first or second or fourth or seventh octant, directs the battery 86 of eight exclusive-OR gates to apply the four least significant bits of y or x address information received from multiplexer 85 or 84 and four ciphers to the 8-parallel-bit input of register reset circuitry 95 to be loaded into the $\Sigma$ TAN $\theta$ register 94 responsive to the "start" command. During each cycle of operation the $\Sigma$ TAN $\theta$ register has its output incremented by tan $\theta$, and the four most significant bits of its output is the desired y- or x-correction for that cycle. Accordingly, decoder 83 directs a battery 96 of four exclusive-OR gates to pass, without complementing, these four bits to the input of correction multiplexer 87.

Responsive to roll angle being in the third or fifth or sixth or eight octant, on the other hand, decoder 83 directs the battery 86 of exclusive-OR gates to complement the four least significant bits of y or x address information and four ciphers for application to the 8-parallel-bit input of register reset circuitry 95. This action causes the four most significant bits of the output of the TAN $\theta$ register 94 to be the complement of the desired y- or x-correction for that cycle, so decoder 83 directs the battery 96 of exclusive-OR gates to complement these bits for application to the input of correction multiplexer 87.

The heart of the deflection-correction-generating apparatus is the accumulator connection of the TAN $\theta$ adder 89 and $\Sigma$ TAN $\theta$ register 94. Its operation will now be particularly described assuming the roll angle $\theta$ to be in the first quadrant between 0° and 45°. Then, $\theta$ equals the roll angle, and the batteries 86, 92 and 96 of exclusive-OR gates 92 generate output signals the same as their input signals. Overflow multiplexer 88 applies overflow information taken from adder 89 and delayed one count cycle in delay circuit 189 to the "enable" input of y-address counter 82, so counter 82 will count only selected ones of the CY CLK pulses supplied to its "count" input; and clock multiplexer 90 applies a continuously supplied "one" to the "enable" input of x-address counter 81 so it will count each of the CY CLK pulses applied to its "count" input. A $\Sigma$ CLK pulse is applied from clock generator 91 to register 94 at the finish of each operating cycle. This operating cycle varies in length depending on the results of the polling of generators 71, 72 and 73. If only vector generator 72 has information to update the display, clock generator 90 will be furnished a continuous CLOCK ENABLE signal from the circuitry polling the outputs of generators 71, 72 and 73, so the clock cycle will be its minimum 800 nanosecond (nS.) length. If one of the generators 71 and 73 has information available to update the display, the CLOCK ENABLE signal will be interrupted to extend the time between finish of CY CLK pulses and start of Σ CLK pulses so cycle time will be 1.6 microseconds (mS.). If both generators 71 and 73 have information available to update the display the time between finish of CY CLK pulses and start of Σ CLK pulses is extended to lengthen cycle time to 2.4 mS.

Figure 5:
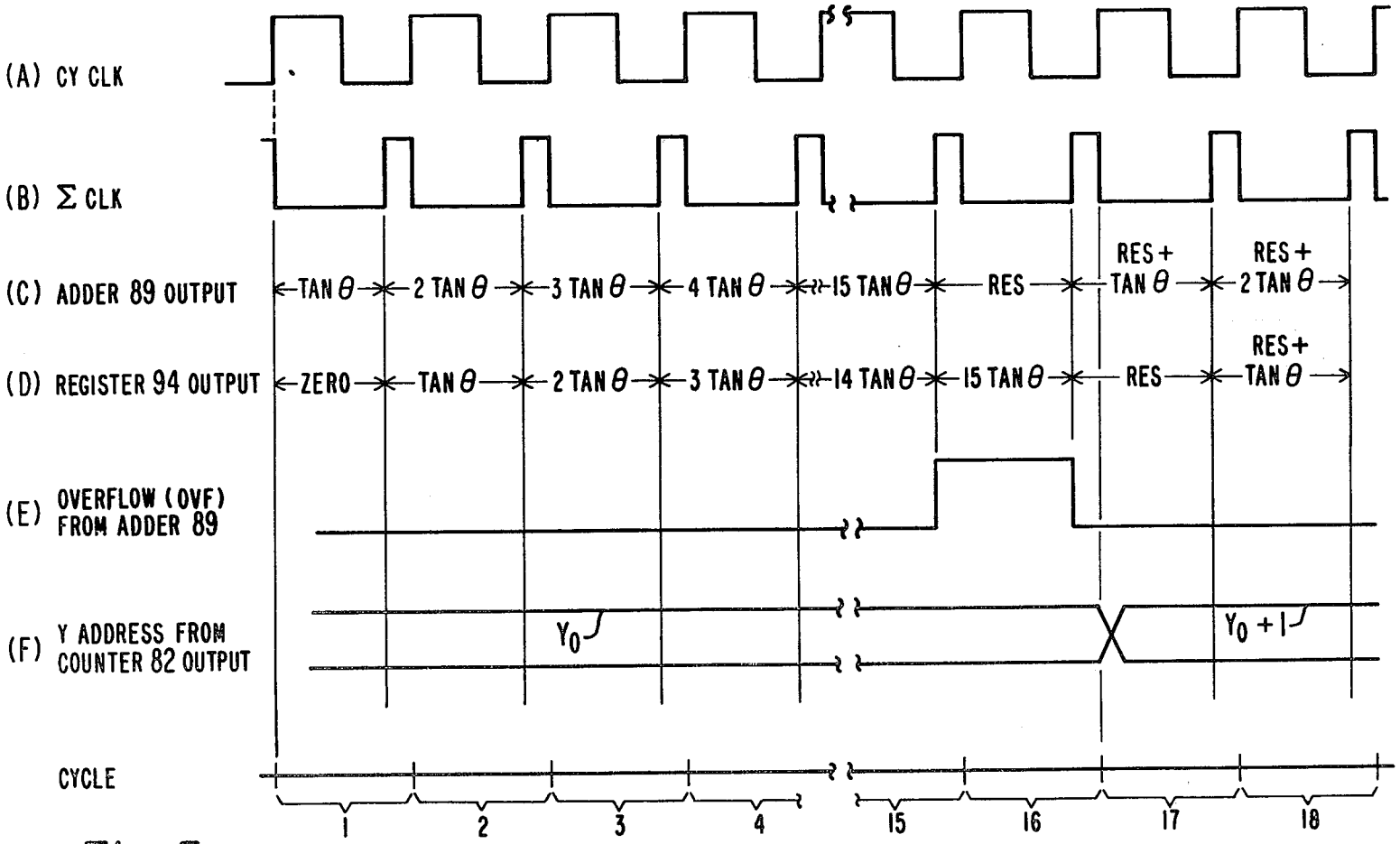
FIG. 5 is a timing diagram showing the time relationships between signals in the FIG. 4 vector generator.

FIG. 5 is a timing diagram showing the generation of y-correction information for a 3.8° roll angle, the tangent of which in binary numbers is 0.001 001, assuming the four least significant bits of the y address coordinate to be 0000, and assuming generators 71 and 73 do not have information available as data input to the update RAM's 52, 54, 56. At the close of the fifteenth cycle of operation adder 89 generates its overflow bit, which delayed by one count cycle in delay circuit 189 on the sixteenth cycle of operation advances the count in the y-address counter 82 output. The y-address will be incremented again each 16-cycle period for this value of roll angle; it would be incremented more or less frequently if the roll angle were bigger or smaller, respectively. The following table describes the conditions for each of the first sixteen cycles of operation shortly after its beginning, binary numbers being written most significant bit first.

| CYCLE # | ADDER 89 OUTPUT | REGISTER 91 OUTPUT | OVF | COUNTER 82 OUTPUT | MUX 77 INPUT |
|---|---|---|---|---|---|
| 1 | 0001 0001 | 0000 0000 | 0 | $Y_0$ | 0000 |
| 2 | 0010 0010 | 0001 0001 | 0 | $Y_0$ | 0001 |
| 3 | 0011 0011 | 0010 0010 | 0 | $Y_0$ | 0010 |
| 4 | 0100 0100 | 0011 0011 | 0 | $Y_0$ | 0011 |
| 5 | 0101 0101 | 0100 0100 | 0 | $Y_0$ | 0100 |
| 6 | 0110 0110 | 0101 0101 | 0 | $Y_0$ | 0101 |
| 7 | 0111 0111 | 0110 0110 | 0 | $Y_0$ | 0110 |
| 8 | 1000 1000 | 0111 0111 | 0 | $Y_0$ | 0111 |
| 9 | 1001 1001 | 1000 1000 | 0 | $Y_0$ | 1000 |
| 10 | 1010 1010 | 1001 1001 | 0 | $Y_0$ | 1001 |
| 11 | 1011 1011 | 1010 1010 | 0 | $Y_0$ | 1010 |
| 12 | 1100 1100 | 1011 1011 | 0 | $Y_0$ | 1011 |
| 13 | 1101 1101 | 1100 1100 | 0 | $Y_0$ | 1100 |
| 14 | 1110 1110 | 1101 1101 | 0 | $Y_0$ | 1101 |
| 15 | 1111 1111 | 1110 1110 | 0 | $Y_0$ | 1110 |
| 16 | 0001 0000 | 1111 1111 | 1 | $Y_0$ | 1111 |
| 17 | 0010 0001 | 0001 0000 | 0 | $Y_0 + 1$ | 0000 |
| 18 | 0011 0010 | 0010 0001 | 0 | $Y_0 + 1$ | 0001 |

The x-address counter 81 output will increment each cycle, responsive to a CY CLK pulse applied to the count input of counter 81. This operation continues until one of the x and y coordinates from counters 81 and 82 reaches the corresponding coordinate of the x, y address of the finishing point of the line vector as determined by a respective digital comparator in the comparator and logic control circuitry 97. If the x coordinate of the finishing point of the line vector is reached during the y-correction process, or if the y coordinate of the finishing point of the line vector is reached during the x-correction process, the comparator making that determination increments the count in a counter that keeps track of how many pixel widths of the line vector have had their address locations determined. The count in this width counter is then compared to the four bits of vector width information contained in the register storing the sixth control word last supplied to the vector generator 72 from the FIG. 2 processor. If the width count has not reached the appropriate value, the comparator making this comparison will supply a "one" to the overflow multiplexer 88. If the y-correction process is in progress, this changes the address stored in the y counter by unity; and the comparator and logic control circuitry 97 also directs counter reset circuitry 80 to reset the x-address counter 81 to the starting point x address. On the other hand, if the x-correction process is in progress, supplying the "one" to the overflow multiplexer 88 input changes the address stored in x counter by unity; and the comparator and logic control circuitry 97 directs counter reset circuitry 80 to reset the y-address counter 82 to the starting point y address. Then the addresses for points along the next pixel width of the line vector will be generated as for the pixel width of line vector just completed. (The offset of the starting and finishing point addresses from the center axis of the line vector in the direction across its width are compensated for in the FIG. 2 processor.)

If the count in the width counter corresponds to the desired line vector width, the comparator and logic control circuitry 97 furnishes a "finish" command which stops the further application of clock signals to the address counter and correction calculation circuitry. The "finish" command also instructs the polling circuitry polling the outputs of generators 71, 72 and 73 to skip over the vector generator 72 in its polling process.

During each cycle of operation from the application of "start" command to the generation of the "finish" command, the vector generator 72 supplies a digital code describing the color of the line vector to the color video multiplexer 75 input. Vector generator 72 during each cycle of operation also supplies a digital code describing the priority of the line vector to the priority multiplexer 78 input. These digital codes are obtained from the registers used for storing the six input words last supplied to vector generator 72 from the FIG. 2 processor.

Line vectors can be generated by accumulating SIN $\theta$ to obtain x address and x deflection correction information and by accumulating COS $\theta$ to obtain y address and y deflection correction information in a way similar to that described by Kazuo Katagi in U.S. Pat. No. 4,106,021 issued Aug. 8, 1978 and entitled "POLAR TO RECTANGULAR COORDINATE CONVERTER." Simply counting clock cycles to obtain one of the x and y addresses and accumulating in TAN $\theta$ to obtain the other address and deflection correction requires less apparatus, however. It also guarantees that deflection correction information will be generated for each pixel traversed by the line vector, without repetition of the same x, y address. Repetition of the same x, y address leads to an over-writing of a memory location that introduces a glitch into the line vector, unless an interpolator is used to average the two different pieces of deflection correction information for the single x, y address. Accumulating in TAN $\theta$ also is desirable in that it permits deflection correction being carried out in one direction only.

Field generator 73 can operate substantially the same as vector generator 72 with the field being painted by successive "strokes" of line vector. This approach takes up an appreciable amount of the total time available for updating the display when the field occupies a major fraction of the display. E.g., the blue field 11 representing the sky over the horizon 16 in the FIG. 1 display takes up about half of the active display area. This is somewhat less than $2^{15}$ elements to be written at 800 nS. per bit rate, which takes about 25.6 mS. minimum time, about half of the 50 mS. total time available for update. If the rest of the display has substantial information content, this means the processor supporting the display generator must be very efficiently programmed to be able to update the display completely in the allowed time. The field generator 73 can be dispensed with, and the time for entering into update memory information concerning when the field is to appear can be considerably shortened, by resorting to a "field tab" method where the vectors describing the boundaries of a field of given color are generated by vector generator 72, are stored, and then are used to control the turning on and turning off of each electron beam required for scanning that color field.

Figure 6:
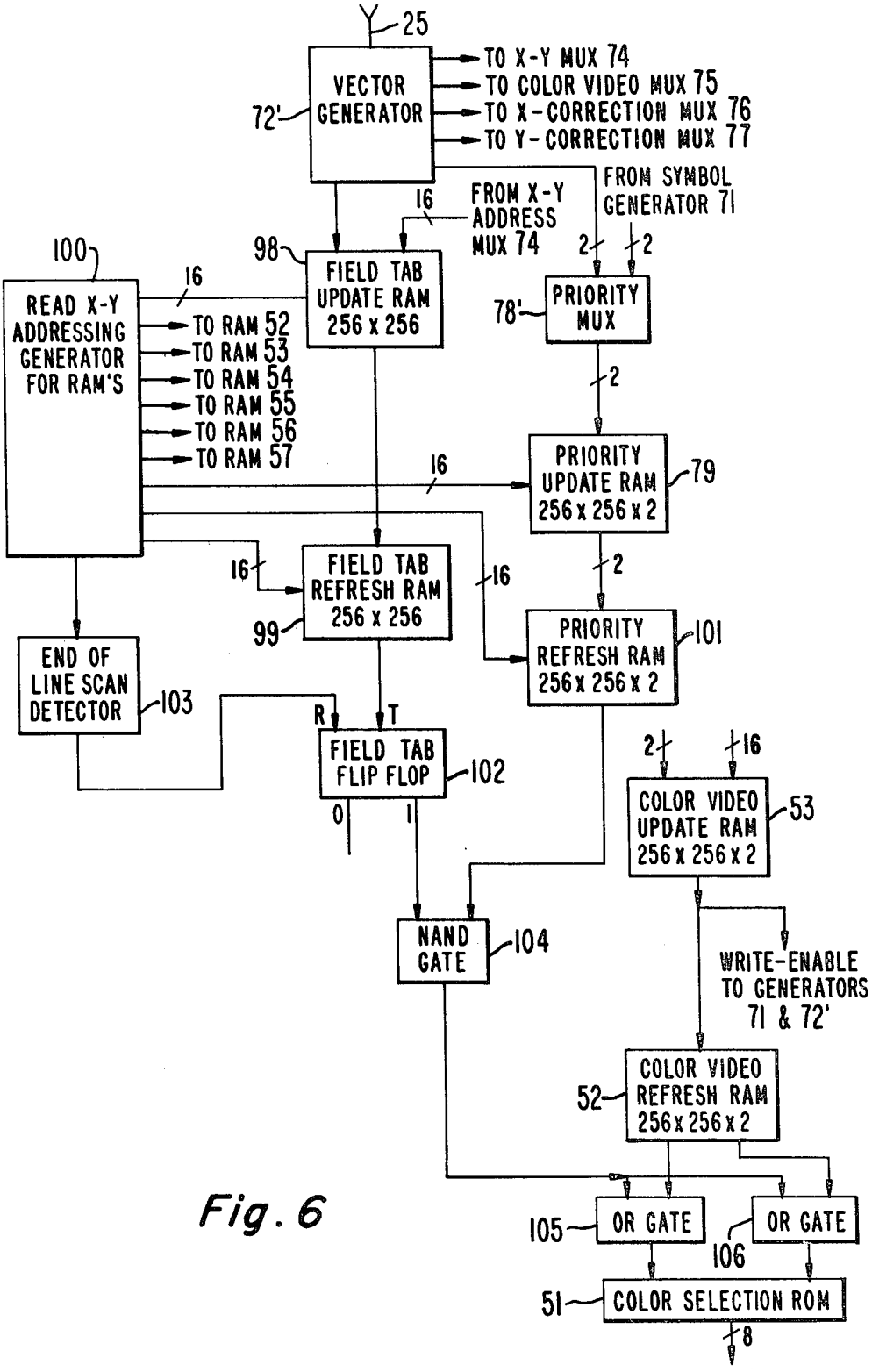
FIGS. 6 and 7 are block schematic diagrams of apparatus for generating field components of the display.

FIG. 6 shows more particularly how this is done. A modified vector generator 72' not only supplies the sixteen bits of x-y addressing information supplied to multiplexer 74, the four bits of color video information supplied to multiplexer 75, the four bits of x-correction supplied to multiplexer 76, the four bits of y-correction supplied to multiplexer 77, and the two priority bits to priority multiplexer 78' (modified from 78 since field generator 73 is no longer used). Vector generator 72' also supplies one bit of field tab information to a field tab update RAM 98, a single 256×256-bit memory plane which receives the x-y address information for its write cycle from x-y address multiplexer 74 output. Update RAM 98, like the other update RAM's 53, 55 and 57, supplies the information to be read out for writing every fourth frame of display. It also supplies during its read out the information for writing a field tab refresh RAM 99, also a single 256×256-bit memory plane, from which the information is taken to refresh the display for the next three frames.

The addressing of update RAM 98 during its being read like that of update RAM's 53, 55, 57 and 79 (both here and in the FIG. 3 apparatus) is taken from read x-y addressing generator 100. This generator 100 typically comprises a 16-bit counter counting output pulses from a master clock oscillator and is used to supply x-y addressing both for reading and writing to the refresh RAM's 52, 54 and 56 (both here and in the FIG. 3 apparatus), field tab refresh RAM 99, and a priority refresh RAM 101 having two 256×256-bit memory planes for storing information supplied from the priority update RAM 79. It is convenient to use this same 16-bit counter to time the generation of the horizontal and vertical synchronization pulses for the raster scan generator 60 of FIG. 3, as well.

The single bit of field tab information supplied by vector generator 72' associated with each x-y address has one value for normal line vectors and another value for line vectors defining field boundaries—e.g., "zero" and "one", respectively—and is stored in RAM's 98 and 99. So as each display frame is read out of memory, the field tab bits associated with a field boundary—e.g., the "ones"—trigger a flip-flop 102, so each field tab bit changes the output state of flip-flop 102. An end of line scan detector 103 detects the end of each scan line—i.e., every 256th bit—in the output signal from the read x-y address generator to apply a reset signal to flip-flop 102. So flip-flop 102 begins every scan line with its output signal in a state which is not such as will enable turning on each of CRT 40 electron beam for painting the field. If a boundary of a field is crossed flip-flop 102 will be triggered into its other state, with its output signal in a state which is such as will enable the generation of each CRT 40 electron beam used to paint the field.

Figure 7:
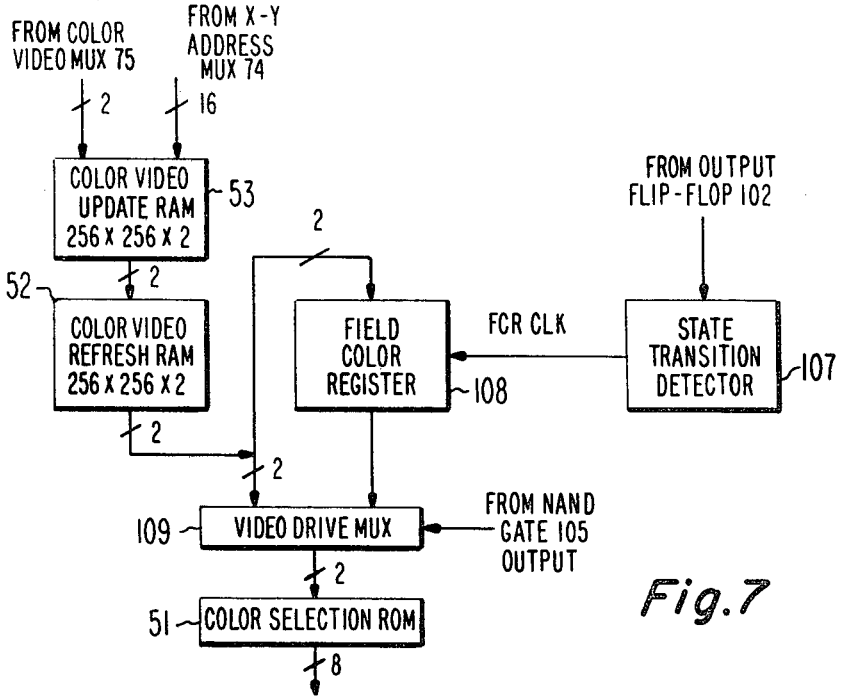

Each CRT 40 electron beam used to paint the field will be turned on only if there is no symbol of higher priority in the memory comprising RAM's 52–57, 79, and 100, however. This is determined by checking the condition of the priority RAM 79 or 101 being read from during that display frame. FIG. 6 shows a NAND gate 104 being used to apply "ones" to inputs of OR gates 105 and 106 if and only if the information from priority RAM 79 or 101 has the lowest priority, and the flip-flop 102 output is "zero," indicating that a left-hand boundary of the field has been crossed. The application of these "ones" to their inputs causes OR gates 105 and 106 to present "ones" in their outputs to the color selection ROM 51 irrespective of information received from the color video RAM 52 or 53 being read, and the "double-one" condition is selected as the code describing the field color. So the electron beams required for painting the field are turned on. This jamming control of the signal applied to the color selection ROM 51 will be exercised only as long as NAND gate 104 produces a "one" in its output. The appearance of priority information other than "double-zero" from the one of priority RAM's 79 and 101 being read from, as occurs during a portion of the field a line vector or symbol is superimposed upon, will cause the output of NAND gate 104 to fall to "zero"; and the output of the color video RAM 52 or 53 being read from will control the outputs of OR gates 105 and 106 and the color of trace on the CRT 40 screen 41. If the right-hand or lower boundary of the field has not been reached after the line vector or symbol has been traversed by scan, the re-establishment of the "double-zero" condition in the output of the one of priority RAM's 79 and 101 being read from, re-establishes a "one" in the NAND gate 104 output and jamming control of trace color by field is re-established. When the right-hand boundary of the field is crossed, the field tab bit supplied from field tab RAM 98 or 99 will trigger flip-flop 102 into its other condition. Flip-flop 102 then supplies a "one" to its input of NAND gate 104 causing NAND gate 104 output to fall to "zero", so the outputs of OR gates 105 and 106 are determined by their inputs from the one of color video RAM's 52 and 53 being read from.

Where more than one color of field is to be written, one may use a suitable plurality of memory planes in each field tab RAM 98 and 99 and replace OR gates 105 and 106 with more sophisticated logic to establish jamming control of field color. However, it is usually most economical of memory to code the color of the field into its boundary vectors (which may be written at lowest or next to lowest priority). Then the color of the field can be established as shown in FIG. 7. A state-transition detector 107 responds to the setting of field tab flip-flop 102 to clock the contents of the one of color video RAM's 52 and 53 being read, into a color register 108 (with as many bits as supplied from RAM's 52 and 53) to be stored for the duration of the line painting the field. A field drive multiplexer 109 responds to the output of NAND gate 105 to apply the contents of register 108, rather than that from the one of color video RAM's 52 or 53 being read, to the input of color selection ROM 51 so long as the line painting the field is not interdicted by a symbol or line vector of higher priority or discontinued by the field tab flip-flop 102 changing its state.

Other modifications of the system described above may be made in the interest of reducing memory requirements. As a first example, the absence of trace condition can be stored in one of the code conditions of the correction memory planes rather than in the color video memory planes; this is advantageous when only one more color condition is needed which would otherwise cost an additional memory plane in color video memory, slight loss of correction resolution being the price paid for this saving. As a second example, if one is satisfied with always beginning and ending a line vector at one of the 256 locations along the axis for which positional correction is not dynamically afforded, one can apply the output of the battery 96 of OR gates in FIG. 4 directly to correction memory shared for x- and y-correction and multiplex after retrieval from memory to effect correction in the desired direction parallel to the x or y axis. An extra memory plane will be required to store the bits that identify whether x-correction or y-correction is used at each pixel location. The FIG. 2 processor can be programmed to furnish instructions for generating the display in order of increasing priority; the update RAM's 53, 55 and 57 then can be re-written by the later, more important data. This will allow the memory for priority bits to be reduced in size, or even eliminated altogether together with supporting circuitry for it (e.g., such as multiplexer 78).

Let the utilization of the parallel-bit streams furnished digital-word-by-digital-word each read interval of the RAM's (from the cyclic reading of the update RAM's 53, 55, and 57 for one raster scan interval followed by the reading of the refresh RAM's 52, 54 and 56 for three succeeding scan intervals) be more specifically considered. In an EADI system built in accordance with the foregoing description, the four parallel x-correction bit streams are converted in converter 58 to a unidirectional analog current with amplitude proportional to the binary number conveyed by those bit streams, which current is applied to the minor horizontal deflection coil 46; and the four parallel y-correction bit streams are converted in converter 59 to a unidirectional analog current with amplitude proportional to the binary number conveyed by these bit streams, which current is applied to the minor vertical deflection coil 47. This arrangement tends to use more power than a system wherein the converters 58 and 59 supply analog current that is zero-valued when the desired pixel locations do not vary from their normal positions during raster scan, and wherein currents proportional to departure of the pixel from normal location are supplied in positive or negative polarities by the converters 58 and 59. A digital-to-analog deflection converter of either form can be designed by an electronic circuit designer of normal skill.

The data stored in the x-correction and y-correction portions of display memory can be used in other ways to correct the position or apparent position of electron beam trace. As one example, consider the following modification to be used instead of the minor deflection coil controlling fine positioning in the direction of rapid scan, and the digital-to-analog-deflection converter driving the coil. An electrically controlled delay circuit is inserted into each video signal channel controlling the emission of electrons from one of the CRT 40 electron guns (normally before video amplifier output stages in the digital-to-analog video converter 50). The amount of delay afforded by this circuit is to be controlled by the binary number formerly applied to the now-dispensed-with digital-to-analog deflection converter.

Figure 8:
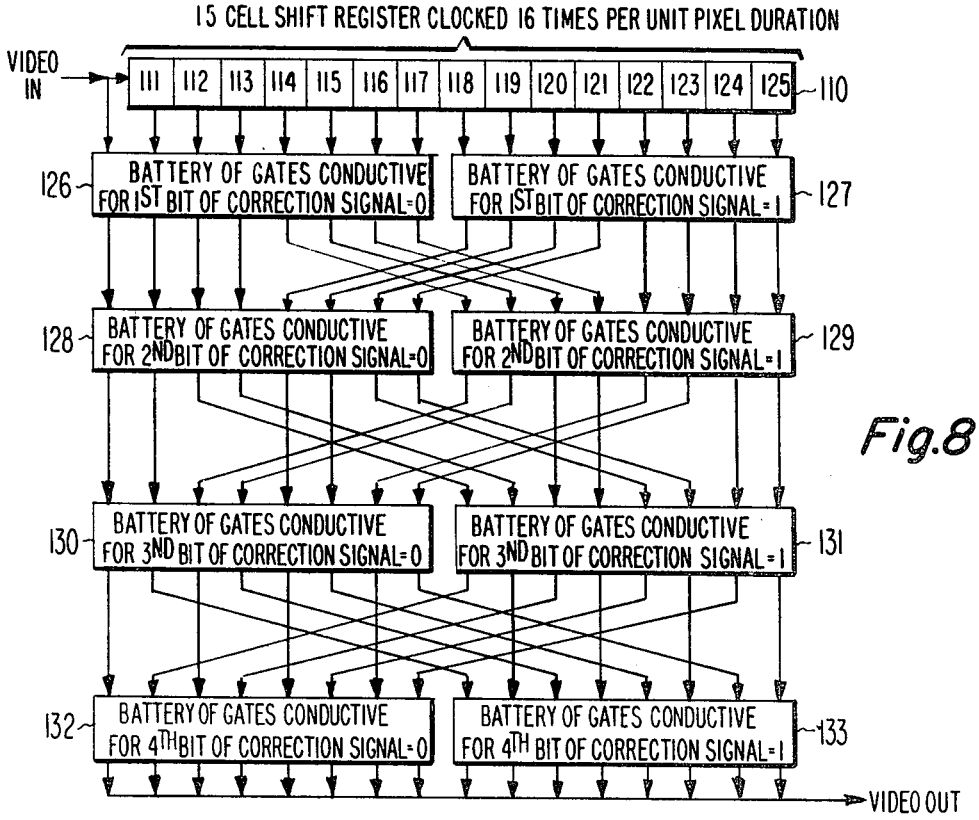
FIG. 8 is a block schematic diagram of an electrically controlled video delay circuit useful in implementing a modification of the FIG. 3 display system in accordance with an aspect of the present invention.

FIG. 8 shows a suitable electrically controlled delay circuit. Each video input signal is clocked from left to right through successive ones of the fifteen cells 111–125 of a shift register 110 at a rate sixteen times the rate the memory RAM's 52–57 are addressed for reading. Batteries 126, 127, 128, 129, 130, 131, 132, and 133 of gates conduct to complete connections between respective ones of their inputs and their outputs in vertical alignment in FIG. 8, responsive to those conditions of the correction signal indicated on the blocks symbolizing the batteries of gates; for the opposite conditions the gates in these batteries are non-conductive. The outputs of the lowest-rank batteries 132, 133 of gates are connected together to supply video output signal delayed proportional to the binary number encoding the correction signal, which correction signal is that which previously supplied the now-dispensed-with digital-to-analog deflection converter.

When the display system uses the "field tab" method of writing field information, controlled video delay has advantage over the use of the minor deflection coil for fine-positioning the trace in the direction of rapid scan, in that it affords correction (without distracting side-effects) in the step discontinuities in field boundaries that form a smaller acute angle with the direction of slow scan than with the direction of rapid scan. E.g., the display of FIG. 1 can have the lower boundary of the blue field respresenting the sky corrected for step discontinuities, as long as the angle of bank does not exceed 45°, by arranging the display system presenting it to have relatively rapid vertical scan and relatively slow horizontal scan (departing from conventional television practice) and to use "field tab".

Figure 9:
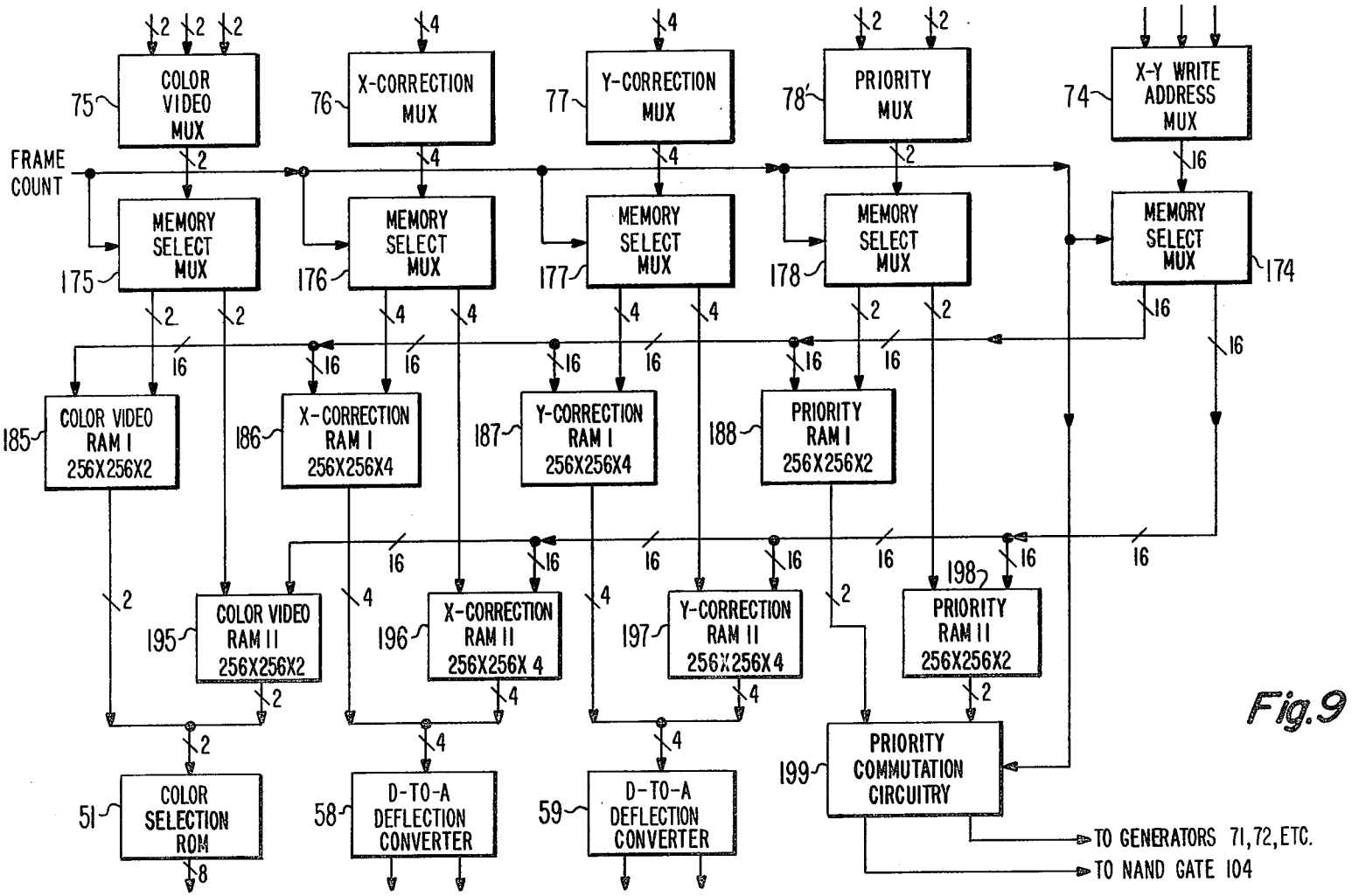
FIG. 9 is a block schematic of an alternative connection of memory elements in the FIG. 3 apparatus, in accordance with an aspect of the invention.

Variations of the memory organization described above can be made without departing from the spirit of the invention. For example, rather than transferring on a regular basis (e.g., each fourth frame) the contents of update RAM's 53, 55 and 57 to refresh RAM's 52, 54 and 56 respectively and to the display, it may be convenient to accomplish these transfers on frames following an indication that display update is complete. This indication is furnished after the FIG. 2 processor has indicated that its contribution to the update process is complete, and after the polling of the generators 71, 72 and 73 indicates that none of them has further information to be transferred to update memory.

Where the amount of information to be displayed is suitably limited, and where the speed with which the display can be updated is suitably fast, it is possible to alternate memories between the update and refresh functions on each successive display frame. FIG. 9 shows such an arrangement.

The frames of the display are counted on a modulo two basis. During odd frames memory select multiplexer 174 supplies write addresses to color video RAM I 185, x-correction RAM I 186, y-correction RAM I 187 and priority RAM I 188; and memory select multiplexers 175, 176, 177 and 178 apply the outputs of color video multiplexer 75, x-correction multiplexer 76, y-correction multiplexer 77, and priority multiplexer 78, to the inputs of RAM's 185, 186, 187 and 188, respectively. That is, during odd frames of the display, RAM's 185, 186, 187 and 188 serve as update memories. The display is refreshed during the odd frames using a color video RAM II 195 to supply information to color selection ROM 51, using an x-correction RAM II 196 to supply minor deflection information to the input of digital-to-analog-deflection converter 58, and using a y-correction RAM II 197 to supply minor deflection information to the input of digital-to-analog-deflection converter 59. During the odd frames of the display, priority commutation circuitry 199 applies the priority bits supplied from priority RAM I 188 to generators 71 and 72 (and 73, if used) to control their generating write-enable signals to be supplied to RAM's 185, 186, 187 and 188. If the field tab method is used, priority commutation circuitry 199 applies priority bits stored in a priority RAM II 198 to NAND-gate 104 in FIG. 6 in place of the input shown applied from priority refresh RAM 101.

During even frames memory select multiplexer 174 supplies write addressed to color video RAM II 195, x-correction RAM II 196, y-correction RAM II 197 and priority RAM II 198; and memory select multiplexers 175, 176, 177 and 178 apply the outputs of color video multiplexer 75, x-correction multiplexer 76, y-correction multiplexer 77, and priority multiplexer 78, to the inputs of RAM's 195, 196, 197 and 198, respectively. During even frames of the display, then, RAM's 195, 196, 197 and 198 serve as update memories. The display is refreshed during the even frames using color video RAM I 185 to supply information to color selection ROM 51, using x-correction RAM I 186 to supply minor deflection information to the digital-to-analog-deflection converter 58, and using y-correction RAM I 187 to supply minor deflection information to the input of digital-to-analog-deflection converter 59. During the even frames of the display, priority commutation circuitry 199 applies the priority bits supplied from priority RAM II 198 to generators 71 and 72 (and 73, if used) to control their generating write-enable signals to be supplied to RAM's 195, 196, 197 and 198. If the field tab method is used, priority commutation circuitry 199 applies priority bits stored in a priority RAM I 188 to NAND-gate 104 of FIG. 6 (in place of the input shown supplied from priority refresh RAM 101).

The advantage of the redundancy in a parallel memory structure being able to maintain the display, despite failure of a portion of memory, may warrant its use with multiplexing between even three or four parallel memories, to reduce the flicker in event of failure and to lengthen the time available for updating the memories.

What is claimed is:

1. In a display system for displaying on a raster-scanned screen of the display system, graphic information extracted from a digitally encoded description, the combination comprising:

a memory for storing graphic information in digital word format at addressable storage locations mapping specified pixel locations in the display, the digital word stored in each storage location associated with a pixel location having a plurality p in number of bits encoding the departure the associated pixel is to have in a prescribed direction on the display screen from the pixel location specified by the storage location address in order to provide additional resolution in the definition of the position of a line or the boundary of an area which is to be displayed, the encoding of the departure being such that the plurality p of bits describe a number greater than p of different departures said pixel can have from its normal position in said prescribed direction, thereby to increase the positional resolution of the graphic information stored in said memory for said prescribed direction, with the attendant increase in memory size by the product of the number of addressable locations in memory times the p bits encoding pixel departures from specified address locations being a substantially smaller increase in memory size than increasing the number of addressable locations available in memory to obtain the additional resolution;

means for reading digital words from said memory in accordance with a scanning pattern related to the raster scanning of the screen of the display system; and means responsive to said digital words for generating signals to control the display presented on said raster scanned screen, including means responsive to said plurality p of bits in each of said digital words for enhancing the resolution of said display in said prescribed direction by substantially more than p times.

2. A combination as set forth in claim 1 wherein said means for reading said digital words from memory includes:

means for addressing locations in said memory in the order that said pixel locations respectively associated with them are scanned on the display screen, to generate a stream of digital words.

3. A combination as set forth in claim 2 further including: positional-resolution-improving means, responding to the portion of said digital words encoding the departures pixels are to have from their normal positions for causing the position of each pixel on the screen of said display system to exhibit the encoded departure from its normal position.

4. A combination as set forth in claim 3 wherein such memory is extended to include in the digital word at each storage location the bits of a digital code description of the one of a plurality of colors in which the associated pixel is to be displayed on said screen.

5. A combination as set forth in claim 4 further including:

color selection means, responsive to the portions of the digital words descriptive of the one of a plurality of colors to be displayed, for selecting the color for display on said screen.

6. A combination as set forth in claim 2 wherein said memory is extended to include in the digital word at each storage location the bits of a digital code descriptive of the one of a plurality of colors in which the associated pixel is to be displayed on said screen.

7. A combination as set forth in claim 6 further including:

color selection means responsive to the portions of the digital words descriptive of the one of a plurality of colors to be displayed for selecting the color for display on said screen.

8. A cathode-ray-tube display system for displaying, with improved resolution on the raster-scanned screen of a cathode ray tube, graphic information taken from a digitally encoded description thereof, said display system including:

a memory having a number of addressed storage locations mapping one-for-one normal pixel locations in the display, the digital word stored in the storage location associated with each normal pixel location including a plurality p in number of bits encoding the departure the pixel is to have in a first direction from the normal pixel location specified by the address of the storage location in order to more accurately describe the position of a line or the boundary of an area which is to be displayed, said encoding being such as to describe more than p possible departures in said first direction;

means for reading said digital words from said memory in the order that said normal pixel locations are scanned on the screen of the cathode ray tube to generate a stream of digital words; and means, responding to the p bits of the digital words being read which encode the departures in a first direction pixels are to have from their normal locations to cause the position of each pixel on the screen of said cathode tube to exhibit the encoded departure from its normal location, for improving the resolution with which said graphic information is displayed on the screen of the cathode ray tube.

9. A display system as set forth in claim 8 wherein said cathode ray tube is of a type with principal deflection coils generating an electromagnetic field for deflecting each cathode ray electron beam through its normal raster scan and wherein said positional-resolution-improvement means includes:

a first digital-to-analog converter means for converting the p bits of the digital words being read which encode the departures in said first direction pixels are to have from their normal locations to a first minor deflection current; and a first minor deflection coil connected to conduct said minor deflection current, responding to said first minor deflection current for generating a perturbation in said electromagnetic field in said first direction for interpolating between normal scan positions of each said cathode ray electron beam.

10. A display system as set forth in claim 9 wherein said memory has in its storage locations digital words each including a further plurality q in number of bits encoding the departure the pixel is to have from its normal location in a second direction orthogonal to the first direction, and wherein said positional-resolution-improving means further includes:

a second digital-to-analog converter means for converting the q bits of the digital words being read which encode the departures in said second direction pixels are to have from their normal locations to a second minor deflection current; and a second minor deflection coil connected to conduct said second minor deflection current, responding to said second minor deflection current for generating a perturbation in said electromagnetic field in said second direction.

11. A display system as set forth in claim 9 wherein said memory has in its storage locations digital words each including a further plurality q in number of bits encoding the departure the pixel is to have from its normal location in a second direction orthogonal to the first direction, and wherein positional-resolution-improving means further includes:

means for delaying the application of video information to each electron gun of said cathode ray tube for a length of time responsive to an electric control signal; and means, responding to the q bits of the digital words being read which encode the departures in said second direction pixels are to have from their normal locations, for generating said electric control signal.

12. A display system as set forth in claim 8 wherein said positional-resolution-improving means includes:

means for delaying the application of video information to each electron gun of said cathode ray tube for a length of time responsive to an electric control signal; and means, responding to the p bits of the digital words being read which encode the departures in said first direction the pixels are to have from their normal locations, for generating said electric control signal.

13. A raster-scanned display system for displaying on a screen thereof graphic information extracted from a digitally encoded description, said display system including:

at least one generator for generating a description of graphic information as a first stream of parallel-bit words, a first number of the bit streams describing the location of the pixels forming the graphic in more significant and less significant bits, and a second number of the bit streams describing the condition of the pixel at each location;

an update memory having a plurality of memory planes, each addressed during writing by the more significant bits of said first number of bit streams to receive bits of said second number of bit streams and the less significant bits of said first number of bit streams as respective data for storage;

a refresh memory having a plurality of memory planes addressed during writing in accordance with the addressing of said update memory during reading, to have the less significant bits of said first number of bit streams and the bits of said second number of bit streams transferred thereto from corresponding memory planes of said update memory;

means for reading during each raster scan the contents of a selected one of said update and refresh memories as a second stream of parallel-bit digital words descriptive of the departure of each pixel location from normal raster scan position and as a third stream of parallel-bit words descriptive of the condition of the pixel at each respective location; and means responsive to said second and third streams of parallel-bit words for correctly locating and energizing each pixel on the screen.

14. A recurrently frame-scanned display system for displaying on a screen thereof graphic information extracted from a digitally encoded description, said display system including:

means for sequentially scanning in prescribed order to ones of a set of pixel locations on said screen frame after frame;

means for selecting said frame scans into a first set of intermittent groups of frames interleaved with a second set of intermittent groups of frames, each group comprising at least one frame;

at least one generator for generating a description of graphic information as a first stream of parallel-bit words, a first number of the bit streams describing the location of the pixels forming the graphic in more significant and less significant bits, and a second number of the bit streams describing the condition of the pixel at each location;

first and second memories, each having a plurality of memory planes addressed during its writing by the more significant bits of said first number of bit streams to receive bits of said second number of bit streams together with the less significant bits of said first number of bit streams as data for storage;

memory selection multiplexing circuitry, connecting said first memory for reading during said first set of frames and for writing during said second set of frames, and connecting said second memory for reading during said second set of frames and for writing during said first set of frames, addressing for the one of said first and second memories connected for reading corresponding with the sequentially scanning in prescribed order of said set of pixel locations on said screen;

means for reading the contents of the one of said first and second memories connected for reading as a second stream of parallel-bit digital words descriptive of the departure of each pixel location from normal raster scan position and as a third stream of parallel-bit words descriptive of the condition of the pixel at each respective location; and means responsive to said second and third streams of parallel-bit words for correctly locating and energizing each pixel scanned to on the screen.

15. A raster-scanned display system comprising:

means for receiving a digital code describing the x and y coordinates of the starting address of a line vector or boundary of a field;

means for receiving a digital code describing a finishing address of said line vector or field boundary;

means for receiving a digital code describing an angular bearing of said line vector or field boundary;

means for receiving a digital code with a first number of bits describing the chromatic condition of said line vector or field boundary;

accumulator means for altering during each of a series of cycle times at least one of the x and y coordinates of said starting address by changes determined from said digital code describing an angular bearing until such time as a correspondence is achieved between responses to the changed address coordinate and the digital code describing the finishing of said line vector or field boundary, thereby to generate the addresses of each point defining said line vector or field boundary;

means for separating the x and y coordinates of the addresses of each point defining said line vector or field boundary into a second number of more significant bits and a third number of less significant bits;

an update memory having a plurality of memory planes arranged for x-y addressing by said second number of bits during the writing into these planes as respective input data ones of the first number of bits describing the chromaticity of said line vector or field and certain of those of said third number of bits describing the less significant bits of the x and y coordinates of the points defining said line vector or field boundary, at least those exhibiting change from cycle to cycle;

a refresh memory having a plurality of memory planes addressed during writing in accordance with the addressing of said update memory during reading, to have information stored in locations in said update memory transferred to corresponding locations in said refresh memory as input data;

means for reading the contents of a selected one of said update and refresh memories according to a raster scanning of its x-y addressing, on a continuously recurring basis to generate a first parallel-bit stream of output data encoding said first number of bits and a second parallel-bit stream encoding the less significant bits of the x and y coordinates of the addresses of the points defining said line vector or field boundary;

a display screen;

means for determining the normal locations of pixels on said display screen according to a raster scanning corresponding point-by-point to the raster scanning of the memory planes of the one of the update and refresh memories selected for reading;

means for converting said first parallel-bit stream into control of the chromaticity of the pixels successively displayed on the display screen; and means for converting said second parallel-bit stream into control of the departure of pixels from their normal positions on the display screen.

16. A raster-scanned display system comprising:

means for receiving a digital code describing the x and y coordinates of the starting address of a line vector or boundary of a field;

means for receiving a digital code describing the finishing of said line vector or field boundary;

means for receiving a digital code describing an angular bearing of said line vector or field boundary;

means for receiving a digital code with a first number of bits describing the chromatic condition of said line vector or field boundary;

accumulator means for altering during each of a series of cycle times at least one of the x and y coordinates of said starting address by changes determined from said digital code describing an angular bearing until such time as a correspondence is achieved between responses to the change of address coordinate and the digital code describing the finishing of said line vector or field boundary thereby to generate the addresses of each point defining said line vector or field boundary;

means for separating the x and y coordinates of the addresses of each point defining said line vector or field boundary into a second number of more significant bits and a third number of less significant bits;

first and second memories, each having a plurality of memory planes arranged for x-y addressing by said second number of bits during the writing into these planes as respective input data ones of the first number of bits describing the chromaticity of said line vector or field, and certain of those of said third number of bits describing the less significant bits of the x and y coordinates of the points defining said line vector or field boundary, at least those exhibiting change from cycle to cycle;

means for cyclically and alternatively reading the contents of each of said first and second memories according to a raster scanning of its x-y addressing while the other is available for writing, to generate a first parallel-bit stream of output data encoding said first number of bits and a second parallel-bit stream encoding the less significant bits of the x and y coordinates of the addresses of the points defining said line vector or field boundary;

a display screen;

means for determining the normal locations of pixels on said display screen according to a raster scanning corresponding point-by-point to the raster scanning of the memory planes of the one of said first and second memories selected for reading;

means for converting said first parallel-bit stream into control of the chromaticity of the pixels successively displayed on the display screen; and means for converting said second parallel-bit stream into control of the departure of pixels from their normal positions on the display screen.

17. In a raster-scanned display systen for displaying, with improved positional resolution on a screen of the display system, graphic information extracted from a digitally encoded description—the combination comprising:

a memory for storing said graphic information in digital word format at addressable storage locations mapping normal pixel locations in the display, there being a plurality p in number of bits in the digital word stored in each storage location corresponding with a pixel, said plurality of bits encoding $2^p$ possible variations in the positioning of that pixel including its normal location, without regard to the hue of that pixel;

means for reading said digital words from said memory;

and means responding to said plurality of bits encoding descriptions of departures of pixels from normal locations for causing those departures in the pixels of the graphic image to be displayed on the screen of said display system.

18. A combination as set forth in claim 17 wherein said digital word comprises bits providing additional resolution in the addresses of points on the display screen beyond that in bits used to select addressable locations in said memory.

19. A combination as set forth in claim 18 including:

at least one generator for generating a description of graphic information in successive pairs of orthogonal spatial coordinates;

means for separating the more significant bits of each spatial coordinate from its less significant bits;

means for applying the more significant bits of each pair of spatial coordinates to said memory for selecting a storage location to be written into; and means for forming from the less significant bits of that pair of spatial coordinates at least a portion of the digital word written into that storage location.

* * * * *